US009120138B2

(12) United States Patent
Bordner

(10) Patent No.: US 9,120,138 B2
(45) Date of Patent: Sep. 1, 2015

(54) FORGED SIDEWAYS EXTRUSION

(71) Applicant: National Machinery LLC, Tiffin, OH (US)

(72) Inventor: Mark W. Bordner, Attica, OH (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 329 days.

(21) Appl. No.: 13/648,480

(22) Filed: Oct. 10, 2012

(65) Prior Publication Data

US 2014/0096584 A1 Apr. 10, 2014

(51) Int. Cl.

| | |
|---|---|
| ***B21J 5/02*** | (2006.01) |
| ***B21D 51/14*** | (2006.01) |
| ***B30B 3/02*** | (2006.01) |
| ***B21J 9/02*** | (2006.01) |
| ***B21D 19/08*** | (2006.01) |
| ***B21C 23/00*** | (2006.01) |
| ***B21C 23/18*** | (2006.01) |

(52) U.S. Cl.

CPC ..... *B21J 5/025* (2013.01); *B21C 23/001* (2013.01); *B21C 23/183* (2013.01); *B21D 19/082* (2013.01); *B21D 19/088* (2013.01); *B21D 51/14* (2013.01); *B21J 5/02* (2013.01); *B21J 9/022* (2013.01); *B21J 9/027* (2013.01); *B30B 3/02* (2013.01)

(58) Field of Classification Search

CPC .... B21D 19/082; B21D 19/088; B21D 51/14; B30B 3/02; B21J 5/02; B21J 9/022; B21J 9/027; B21C 23/001; B21C 23/183

USPC ..... 72/253.1, 254–257, 273, 273.5, 343, 72/352, 356, 358, 359, 361, 404, 72/405.01–405.09, 405.11, 405.13, 429, 72/452.1, 452.2, 452.4–452.7, 455, 456

See application file for complete search history.

(56) References Cited

U.S. PATENT DOCUMENTS

| | | | | |
|---|---|---|---|---|
| 8,024,952 | B2 | 9/2011 | Hossler et al. | |
| 2008/0216550 | A1 * | 9/2008 | Krintzline et al. | 72/470 |
| 2009/0241633 | A1 * | 10/2009 | Hossler et al. | 72/482.91 |
| 2009/0260410 | A1 * | 10/2009 | Cho et al. | 72/356 |

* cited by examiner

*Primary Examiner* — David B Jones

(74) *Attorney, Agent, or Firm* — Pearner & Gordon LLP

(57) ABSTRACT

A method and apparatus for forming metal parts in a progressive forming machine wherein one of the opposed tools on a ram and die breast is spring biased to operatively close the tools before the ram reaches front dead center thereby allowing material of the blank to extrude sideways through an aperture formed by both of the opposed tools in the final forward movement of the ram.

7 Claims, 3 Drawing Sheets

FORGED SIDEWAYS EXTRUSION

BACKGROUND OF THE INVENTION

The invention relates to forming techniques used in progressive metal formers.

PRIOR ART

Forging or forming machines have long been used to shape cylindrical blanks into more complex shapes. A common forming method involves upsetting or coning dies in which a blank is axially compressed to expand it radially. There are limits to the amount of radial expansion that can be obtained in a single forming blow without unacceptable buckling of the blank. Consequently, in a progressive former, several stations may be required to produce a desired radially extending shape. On the other hand, some parts may require a reduction in area using an extrusion technique but, again, such processes have physical limits, as recognized in the industry. Still further, to form some irregularly shaped parts using customary processes, it can be necessary to trim a large volume of material from the blank so that the resulting scrap adds significant costs to a process.

SUMMARY OF THE INVENTION

The invention involves lateral extrusion of a blank in a workstation in a progressive forming machine. The invention allows various metal parts to be shaped in fewer stations than has been required in the past, can produce parts with lateral extensions exhibiting a high reduction in area and/or a finished thickness and, can reduce a percentage of scrap by eliminating or reducing the amount of material required to be trimmed from asymmetric and/or accircular parts.

The invention employs a spring biased slidable tool. During sliding movement, a tool cooperating with an opposed tool is arranged to form a sideways extrusion. The spring biased sliding tool allows the final part of a ram stroke to displace blank material through a lateral aperture bounded by the sliding tool and the opposed tool. The spring is arranged to hold the tools in fixed relation during this blank extrusion step against forces developed in the blank.

The sliding tool can be mounted on either the ram or the die breast of the progressive forming machine. The spring allows the slidable tool to recede on the part of the machine on which it is mounted while the ram is approaching front dead center (FDC) and displacing blank material through the lateral extrusion aperture.

DESCRIPTION OF THE PREFERRED EMBODIMENTS

Figure 1:
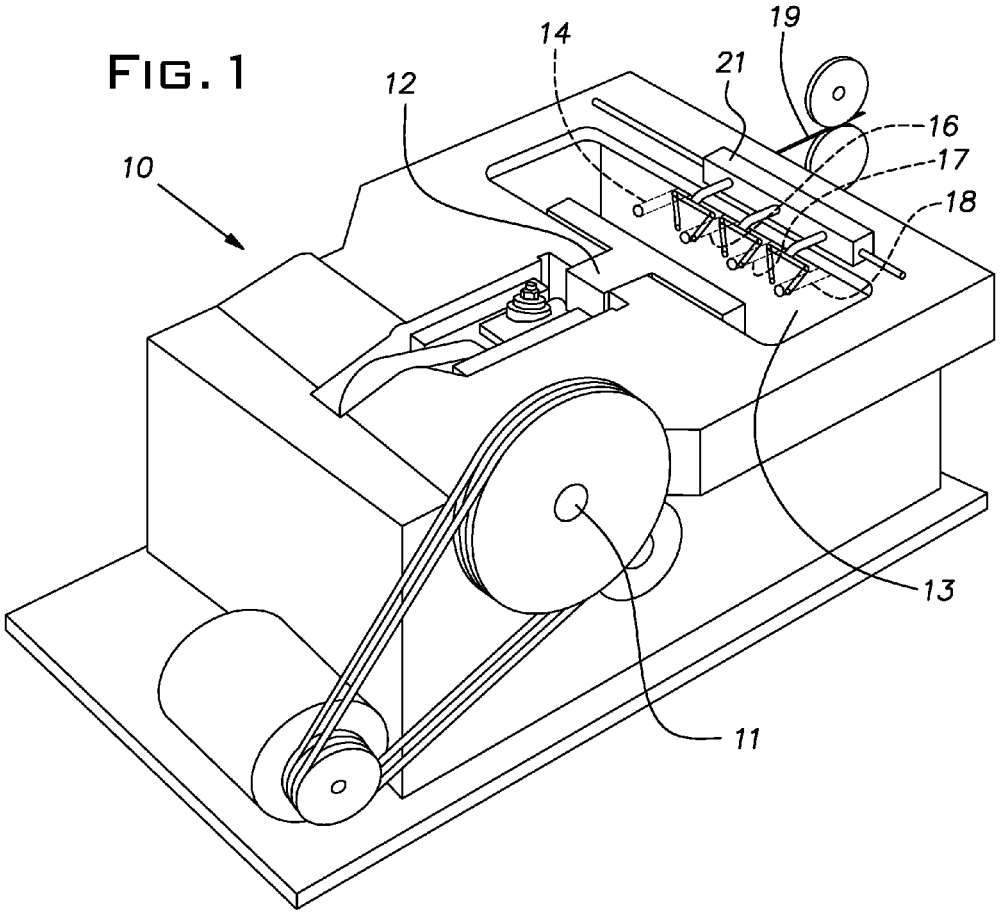
FIG. 1 is a diagrammatic isometric view of a progressive forming machine used to practice the invention.

FIG. 1 schematically illustrates a progressive forming machine 10. Rotation of a crankshaft 11 reciprocates a ram or slide 12 towards and away from a die breast or bolster 13. The machine 10 is shown with uniformly horizontally spaced cutoff station 14 and three workstations 16-18. The invention, as will be understood with those familiar in the art, can be practiced with machines of a different number of stations. In a customary manner, blanks are cut from round wire stock 19 by a shear at the cutoff station 14 and then are transferred by a mechanism 21 to successive stations 16-18 in timed relation to reciprocation of the ram.

Figure 2:
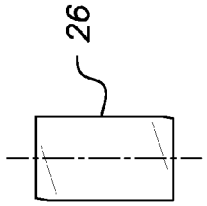
FIGS. 2-5 show a progression of a blank being formed with the invention.
Figure 3A:
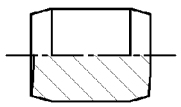
Figure 3B:
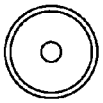

FIGS. 2-5 illustrate various stages of the forming of a workpiece in an application of the invention. An initial blank 26 produced at the cutoff station 14 is shown in FIG. 2. Typically, the generally cylindrical blank 26 has irregular ends, a result of the shearing process at the cutoff station 14. The blank 26 is struck in a die and punch at the first station 16 to square up its ends shown in FIGS. 3A, 3B and thereby improve the quality and uniformity of a finished part.

Figure 4A:
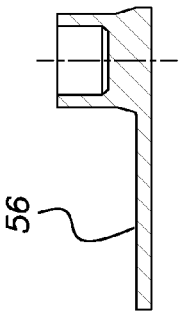
Figure 4B:
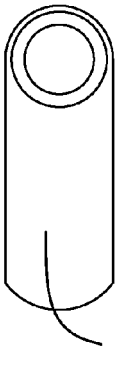
Figure 5A:
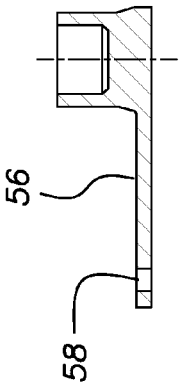

At the second workstation 17, the blank 26 is uniquely shaped with a sideways or lateral extrusion step shown in FIGS. 4A, 4B in accordance with the invention. In the exemplary part being illustrated, the blank 26 is also backward extruded at this second workstation 17. In the third station 18, the exemplary part or workpiece is finished by punching a hole in its laterally extruded section as shown in FIG. 5A, B.

The cutoff, square-up and hole punching operations and tooling to accomplish the same at the respective cutoff, first and third stations are generally conventional and need no further explanation for an understanding of the invention.

Figure 6:
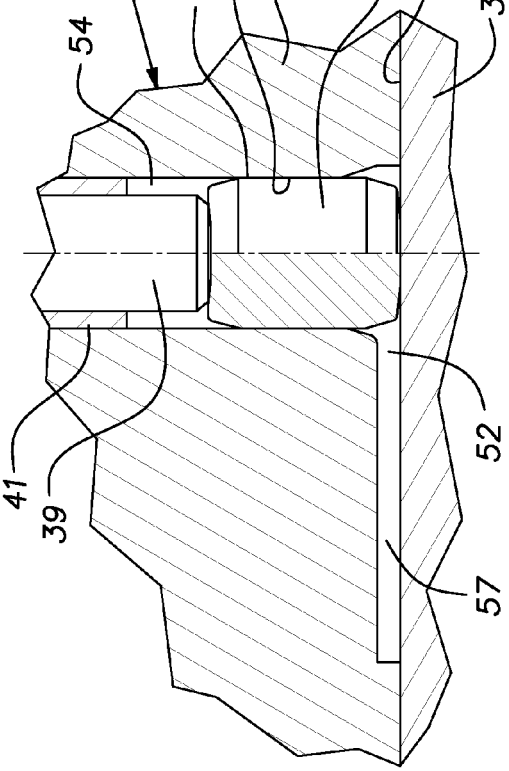
FIG. 6 is a somewhat simplified enlarged fragmentary sectional view of the tooling and blank prior to forming at the workstation of FIG. 7.

FIG. 6 illustrates tooling comprising a tool or die 31 and tool or punch assembly 32 at the second station 17 on an enlarged scale. The tooling 31, 32 is shown in a position where the blank 26, received from the first workstation 16 where it was squared up, is just about to be reshaped as the ram 12 approaches FDC.

Figure 7:
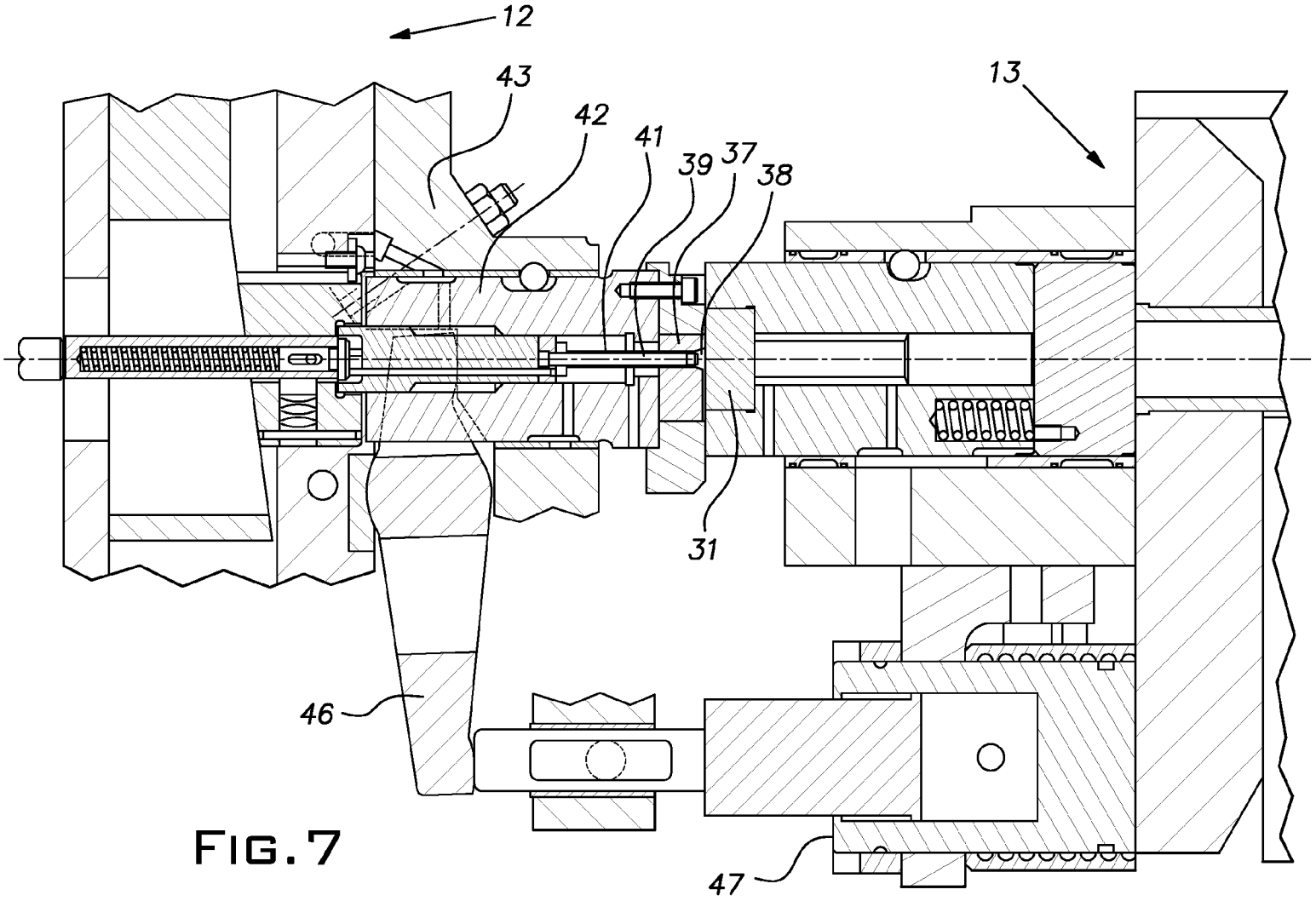
FIG. 7 is a side view of a work station of the machine of FIG. 1 at which steps of the invention are performed.

FIG. 7 illustrates the tooling 31, 32 at the second station 17 in greater detail with the ram 12 at FDC and the blank 26 as it is fully shaped at this stage in the progression as is also shown at FIG. 4A, B. The die 31 mounted on the die breast, generally indicated at 13 in FIG. 7, in the illustrated case presents a flat surface 36, transverse to the horizontal axis of ram motion, against which the blank 26 is formed. The tool or punch assembly 32 mounted on the ram 12 includes an insert 37 having an internal cavity 38 for shaping the blank 26, a punch pin 39 and a sleeve 41 all carried in a case 42. The case 42 is slidably mounted for limited axial movement relative to the ram 12 in a holder 43 fixed to the ram. The insert 37 is resiliently biased through its supporting case 42 towards the die 31 by a high pressure lever 46 such as disclosed in U.S. Pat. No. 8,024,952. The lever 46, carried on and pivotal on the ram 12, multiplies a force developed by a gas spring 47 stationarily mounted on the frame of the machine adjacent the die breast 13. The gas spring 47 is effective on the lever 46 when the ram 12 approaches FDC.

The sequence of movement of the tooling at the second station 17 follows the transfer of the blank 26 to this station (and the simultaneous transfer of the previous blank to the succeeding station 18). With the blank 26 transferred, the ram 12 advances towards the die breast 13 carrying the tool assembly 32 biased by the spring 47 and lever 46 so that these tool parts lead the ram. Prior to FDC, the face of the tool assembly insert 37 engages the die 31. Together the cavity of the insert 37 and die 31 define the shape of the blank 26 to be produced at this station 17. The blank shape is depicted in FIGS. 4A and 4B. The majority of the external shaped surfaces of the blank 26 formed at this station 17 is determined by internal surfaces of the cavity 38 in the tool insert 37.

The cavity 38 has a cylindrical bore 51 of a diameter sufficiently large to receive the blank 26 shaped at the first station 16. The face of the tool insert 37 mates with the die 31 by fitting tightly against the flat face of the die. At one side of the bore 51 is a rectangular aperture having a boundary partially formed by the face of the die 31. With the faces of the tool insert 37 and die 31 held tightly together by the high pressure lever 46 to prevent escape of material of the blank 26 at their interface, the ram 12 advances towards the die breast 13 driving the punch pin 39 into the blank.

Initially, with the punch pin 39 and sleeve 41 moving in unison with the ram 12, the blank 26 back extrudes to fill a space 54 (FIG. 6) behind the lead end of the punch pin and in front of the sleeve 41. Small vents, not shown, run longitudinally along the outer surface of the sleeve 41 to release air and lubricant otherwise trapped in this area. When the space 54 behind the front face of the punch pin 39 is filled, the blank material is extruded laterally out of the aperture 52 defined between the punch insert 37 and die 31. The space 54 around the punch pin 39 is filled before the lateral extrusion begins since this backwards extrusion requires less pressure on the material than does the extrusion through the lateral or sideways aperture 52. The blank material continues to extrude to form a lateral extension or wing 56 until the ram 12 reaches FDC.

Preferably, the aperture 52 is slightly smaller in cross-section than a space 57 that receives and generally confines the extruded material. Stated otherwise, the receiving space 57 is provided with a slight dimensional relief, i.e. made slightly larger in cross-section than the aperture 52. This relief reduces resistance to flow of blank material through the space 57. An end of the receiving space or channel 57 can be closed (apart from suitable air and lubricant venting) to shape the extremity of the extension 56 or can be open. The receiving space 57 is primarily formed in the insert 37 but has a part of its boundary or side formed by the die 31.

Figure 5B:
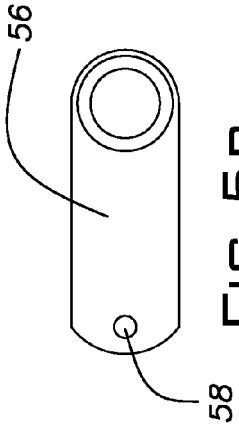

The ram 12 retracts; when the retraction exceeds the slide movement of the punch assembly 32, the punch assembly carried by the ram 12 retreats from the die 31 to eventually release the blank 26 for transfer to the third station 18. The punch assembly sleeve 41, in the illustrated arrangement, can be used to hold the blank 26 in place on the flat face of the die 31 until it is under control of the transfer mechanism 21. At the third station 18, the lateral extension 56 can be further shaped; FIGS. 5A and 5B show the result of being worked by a punch that has formed a hole 58. Other work such as trimming, bending, twisting, cupping, shaping can be done to the blank extension 56, and/or the remainder of the blank 26 at this third station 18 or any additional work station.

The extrusion process is distinguished over a traditional upset or coning operation in that the material of a blank being forced into the extruded shape including that contacting, but slipping over, the confining and shaping die and punch tools is all displaced by succeeding increments of blank material. In an upset or coning, the blank material at the confining punch and die surfaces does not slip across these surfaces.

The lateral or sideways extrusion technique of the invention represented by the foregoing example, can offer many benefits over traditional forming steps. An extruded detail can, as illustrated, be limited to a fraction of the circumference of the blank thereby reducing or eliminating the need to trim material from a workpiece that is asymmetrical or accircular in finish form. The aperture 52 can be dimensioned to produce a lateral extension 56 with a finished thickness or cross section. A workpiece or part can be produced with more than one lateral extension at multiple locations around the circumference in a single forming station. The aperture can extend through 360 degrees around the axis of the original blank to create a full peripheral rim or flange. The die face can have formations other than the disclosed flat to shape a part as long as the punch assembly and die cooperate to form the extrusion orifice and receiving space analogous to the space 57 and allow the extruded extension to be released after it is formed. The spring biased sliding tool can be mounted on the die breast or bolster 13 rather than in the illustrated arrangement where it is mounted on the ram 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of forming a workpiece comprising transferring a metal blank to a workstation in a multi station forging machine with a stationary die breast part and a reciprocating ram part, mounting a set of opposed tools on the die breast part and the ram part at the workstation that when closed relative to one another cooperate to define both a working cavity and a lateral extrusion aperture, one of the tools being provided with a mechanism capable of holding the one tool towards the other opposed tool with a force adequate to maintain the tools in fixed relation to one another in opposition to pressure forces in the blank as the blank is worked during a final period of ram motion towards the die breast with the configuration of the aperture fixed, and extruding material of the blank laterally through the aperture as the one tool retracts relative to the part of the machine on which the one tool is mounted.

2. A method as set forth in claim 1, wherein the aperture has a shape corresponding to at least a portion of the desired shape of a finished part.

3. A method as set forth in claim 1, wherein the aperture produces a lateral extension on the blank that is greatly reduced in cross sectional area from that of a major cross sectional area of the blank as it is delivered to the workstation having the lateral aperture.

4. A method as set forth in claim 1, wherein the tools forming the aperture are arranged to form a receiving space having the general shape of the aperture and are adapted to confine the laterally extruded portion of the blank to a desired shape.

5. A method as set forth in claim 4, wherein the receiving space is arranged to provide a cross section slightly larger than the cross section of the aperture.

6. A method as set forth in claim 1, wherein the blank is transferred to a subsequent workstation in the progressive forging machine and is further worked by trimming, perforating or otherwise permanently deforming the lateral extension.

7. Apparatus in a progressive forming machine comprising a tool set for a workstation and a spring, the tool set having tooling adapted for mounting on a die breast member and tooling for mounting on a ram member that reciprocates towards and away from the die breast member, the die breast and ram tooling cooperating to form a cavity for receiving the blank, the die breast and ram tooling each forming a part of a lateral aperture for extruding blank material pressed in said cavity laterally through the aperture, the spring being arranged to bias one of said tooling towards the other of said tooling, said one of said tooling being slidably mounted on the associated member, the spring being arranged to hold the one tooling fixed stationary in relation to the other tooling wherein said tooling establish a working fixed configuration of the lateral aperture before the ram reaches forward dead center, the spring being capable of resisting forces tending to separate the tooling during lateral extrusion of blank material through said aperture.

* * * * *